US011072979B2

(12) United States Patent
Levie et al.

(10) Patent No.: US 11,072,979 B2
(45) Date of Patent: Jul. 27, 2021

(54) CABLE CLAMP

(71) Applicant: X-Holding GmbH, Herford (DE)

(72) Inventors: Iain Levie, Spring, TX (US); David Levie, Lucerne (CH); Greg Roger, Houma, LA (US)

(73) Assignee: X-Holding GmbH, Herford (DE)

( * ) Notice: Subject to any disclaimer, the term of this patent is extended or adjusted under 35 U.S.C. 154(b) by 533 days.

(21) Appl. No.: 15/519,703

(22) PCT Filed: Oct. 22, 2015

(86) PCT No.: PCT/US2015/056821
§ 371 (c)(1),
(2) Date: Apr. 17, 2017

(87) PCT Pub. No.: WO2016/065100
PCT Pub. Date: Apr. 28, 2016

(65) Prior Publication Data

US 2017/0260815 A1 Sep. 14, 2017

Related U.S. Application Data

(60) Provisional application No. 62/067,064, filed on Oct. 22, 2014.

(51) Int. Cl.
*E21B 17/02* (2006.01)
*E21B 19/16* (2006.01)

(52) U.S. Cl.
CPC ..... *E21B 17/026* (2013.01); *E21B 19/16* (2013.01)

(58) Field of Classification Search
CPC ... E21B 17/025; E21B 17/026; E21B 17/1035
See application file for complete search history.

(56) References Cited

U.S. PATENT DOCUMENTS

| | | | | |
|---|---|---|---|---|
| 4,603,578 | A | 8/1986 | Stoltz | |
| 5,343,942 | A | 9/1994 | Del Serra et al. | |
| 5,379,836 | A | 1/1995 | Jordan | |
| 5,973,270 | A | 10/1999 | Keller | |
| 6,929,065 | B2 | 8/2005 | Cannon | |
| 2004/0065437 | A1* | 4/2004 | Bostick, III | E21B 47/011 166/250.01 |

(Continued)

FOREIGN PATENT DOCUMENTS

| | | | |
|---|---|---|---|
| GB | 2398807 | A | 9/2004 |
| WO | 2014-037125 | A2 | 3/2014 |

OTHER PUBLICATIONS

Chan Yoon Hwang (Authorized Officer), International Search report and Written Opinion dated Jan. 18, 2016, PCT Application No. PCT/US2015/056821, filed Oct. 22, 2015, pp. 1-17.

(Continued)

*Primary Examiner* — Christopher J Sebesta
(74) *Attorney, Agent, or Firm* — Heslin Rothenberg Farley & Mesiti P.C.

(57) ABSTRACT

A cable clamp, modified tubular, and method for securing a cable to a tubular. The cable clamp includes a first base that is configured to be attached to the tubular by a bonding material, and a cover that is configured to be placed on the first base. At least one of the first base or the cover defines a groove extending therein, for receiving a cable through the cable clamp.

15 Claims, 14 Drawing Sheets

(56) References Cited

U.S. PATENT DOCUMENTS

| | | | | |
|---|---|---|---|---|
| 2005/0279510 | A1 | 12/2005 | Patel et al. | |
| 2007/0284037 | A1* | 12/2007 | Buytaert | E21B 17/1028 156/294 |
| 2009/0078020 | A1* | 3/2009 | Baxter | B21D 22/02 72/379.4 |
| 2009/0314498 | A1 | 12/2009 | Kannan et al. | |
| 2010/0018697 | A1* | 1/2010 | Richards | E21B 43/08 166/227 |
| 2011/0073323 | A1* | 3/2011 | Coronado | E21B 17/026 166/380 |
| 2011/0303419 | A1* | 12/2011 | Maier | E21B 17/026 166/373 |
| 2012/0024545 | A1 | 2/2012 | Kuo | |
| 2012/0096935 | A1* | 4/2012 | Finke | E21B 47/011 73/152.03 |
| 2014/0014373 | A1 | 1/2014 | Richards | |
| 2015/0337605 | A1* | 11/2015 | Longbottom | C09J 7/29 166/380 |
| 2016/0069141 | A1* | 3/2016 | Blackmon | E21B 19/00 166/380 |
| 2016/0168922 | A1* | 6/2016 | Baustad | E21B 17/1035 166/242.6 |

OTHER PUBLICATIONS

Extended European Search Report dated Jun. 25, 2018, EP Application No. 15853525, filed Oct. 22, 2015, pp. 1-9.

Examination Report dated Oct. 19, 2020, EP Application No. 15853525, filed Oct. 22, 2015, pp. 1-6.

* cited by examiner

CABLE CLAMP

CROSS REFERENCE TO RELATED APPLICATIONS

This application is a national-stage entry of PCT/US2015/056821, filed Oct. 22, 2015, which claims priority to U.S. Provisional Patent Application having Ser. No. 62/067,064, which was filed on Oct. 22, 2014, the contents of all of which are hereby incorporated by reference in their entirety.

BACKGROUND

Oil and gas reservoirs may be exploited by tapping the resources therein via wellbores. Drilling of wellbores may require drilling a considerable distance into the earth. Many oil and gas bearing formations are at sub-sea locations. The direction of drilling may vary from a vertical position to a horizontal position. The wellbore created by drilling may be stabilized by use of a casing, a lining or by other measures. Tubular bodies (hereinafter "tubulars") may be positioned in the wellbore. Sometimes cables (e.g., control lines) are attached to an outside surface the tubulars during deployment. As such, there is a need for a cable clamp to attach the cables to the tubulars.

SUMMARY

Embodiments of the present disclosure may provide a cable clamp for attaching a cable to a tubular. The cable clamp includes a first base that is configured to be attached to the tubular by a bonding material, and a cover that is configured to be placed on the first base. At least one of the first base or the cover defines a groove extending therein, for receiving a cable through the cable clamp.

Embodiments of the present disclosure may also provide a method for attaching a cable to a tubular. The method includes attaching a first base to a first tubular. Attaching the first base includes injecting a bonding material into a cavity defined between an inner surface of a shell of the first base and the first tubular. The method also includes positioning a cable along the first base, such that the first base is radially between the cable and the first tubular, and securing a cover to the first base. The cable is positioned in a passageway defined by the cover, the first base, or both.

Embodiments of the present disclosure may also provide a modified tubular including a tubular and a plurality of cable clamps positioned at one or more angular intervals around the tubular. Each of the plurality of cable clamps includes a base including a prefabricated shell that defines a cavity between an inner surface thereof and the tubular, and a bonding material disposed in the cavity, the bonding material securing the shell to the tubular. The cable clamps also each include a cover secured to the base. At least one of the base and the cover includes a groove extending axially therethrough and configured to receive a cable.

BRIEF DESCRIPTION OF THE DRAWINGS

An understanding of certain embodiments of the present disclosure may be furthered by referring to the following description and accompanying drawings. In the drawings.

DETAILED DESCRIPTION

Figure 1:
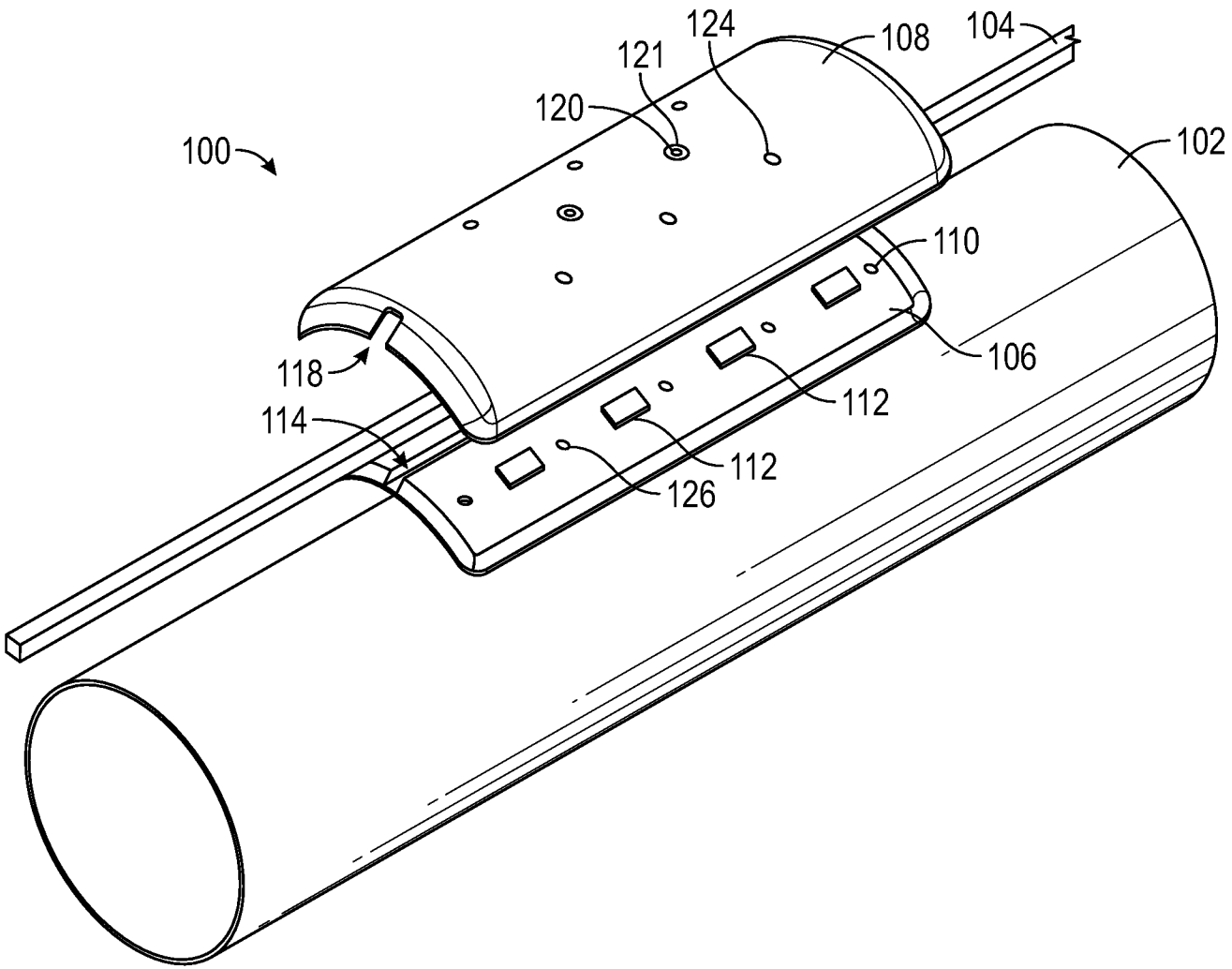
FIG. 1 illustrates as exploded, perspective view of a cable clamp on a tubular, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates an exploded, perspective view of a cable clamp 100 positioned on a tubular 102, according to an embodiment. The cable clamp 100 may be configured to attach a cable 104 to the tubular 102, such that the cable 104 extends generally longitudinally with respect to the tubular 102 and is retained in place circumferentially, axially, and/or radially with respect thereto by the cable clamp 100.

The cable clamp 100 may include a base 106 and a cover 108. It will be appreciated that one or more intermediate shells may be provided, e.g., between the base 106 and cover 108. The base 106 may be bonded onto the outer surface of the tubular 102, as will be described in greater detail below. Further, the cover 108 may be received and secured onto a radial outside of the base 106, e.g., via adhesive, fasteners, etc.

In a specific embodiment, the cable 104 may extend through, and be retained at least circumferentially and radially in, a passageway defined axially through the cable clamp 100, as will be described in greater detail below. As such, the base 106 may be positioned radially between the tubular 102 and the cable 104. In an embodiment, the passageway may be defined by a groove 114 formed in the base 106 and/or a groove 118 formed in the cover 108. In the illustrated embodiment that includes both the groove 114 and the groove 118, the grooves 114, 118 are aligned and extend generally axially through the cable clamp 100, so as to cooperatively define the passageway for the cable 104.

The cable 104 may be received through the grooves 114, 118. The cable clamp 100 may also include connection members 120, such as brass, steel or composite set screws, which may be received generally radially through holes 121 defined through the cover 108 and may be configured to secure the cable 104 in the passageway (e.g., the groove 114 and groove 118). Further, the cover 108 may define holes 124 therein, which may align with holes (e.g., threaded holes) 126 formed in the base 106. Connection members (not visible in FIG. 1; see, e.g., FIGS. 8 and 9) may be received through the holes 124, 126 in order to secure the cover 108 to the base 106. In another embodiment, the cover 108 may be attached to the base 106 via a "snap-and-lock" arrangement. For example, the cover 108 may have a projection, such as a hook, that is inserted (or snapped) into a profile in the base 106 and locked into place. The projection on the cover 108 may be coated with an adhesive, such as glue or thread lock prior to insertion into the profile of the base 106. In still another embodiment, the base 106 may include the hook and the cover 108 may include the profile for the snap-and-lock connection. It will be appreciated that any suitable device, process, or the like may be employed to secure the cover 108 to the base 106 (including, for example, the use of an intermediate structure or shell).

As also shown in FIG. 1, the base 106 includes a plurality of upsets 112, such as dowels, ridges, etc. The upsets 112 may be received into corresponding recesses formed on an inside of the cover 108 (not visible in FIG. 7; see, e.g., FIGS. 8 and 9). The upsets 112 may thus serve to guide the cover 108 onto the base 106. Further, the interlock between the upsets 112 and the cover 108 may bear circumferentially-directed and/or axially-directed loads applied to the cover 108. In turn, the base 106 may transmit such loads to the tubular 102, thereby providing a stable platform for retaining the cable 104. In some embodiments, the cover 108 may include upsets and the base 106 may include recesses configured to receive and interlock therewith.

Figure 2:
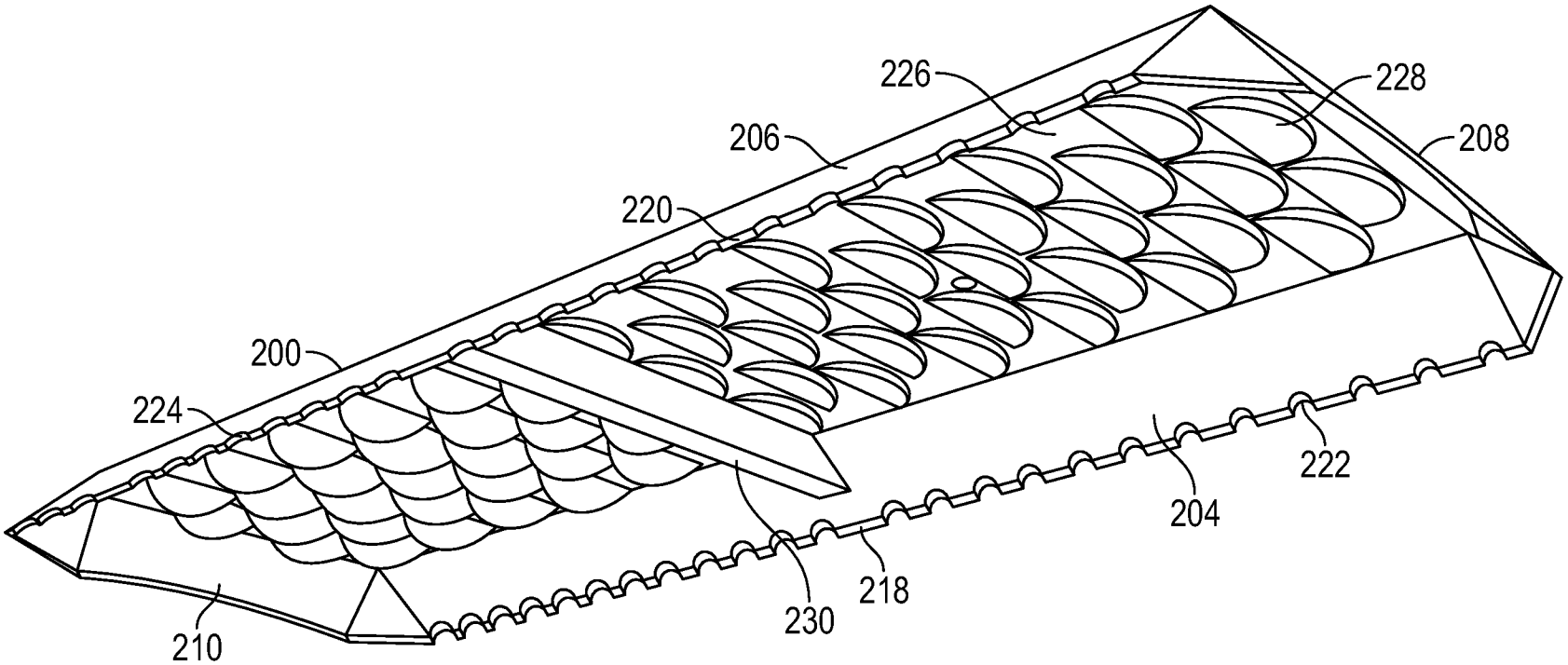
FIG. 2 illustrates a bottom perspective view of a shell that may be used in constructing a base of the cable clamp, according to an embodiment.
Figure 3:
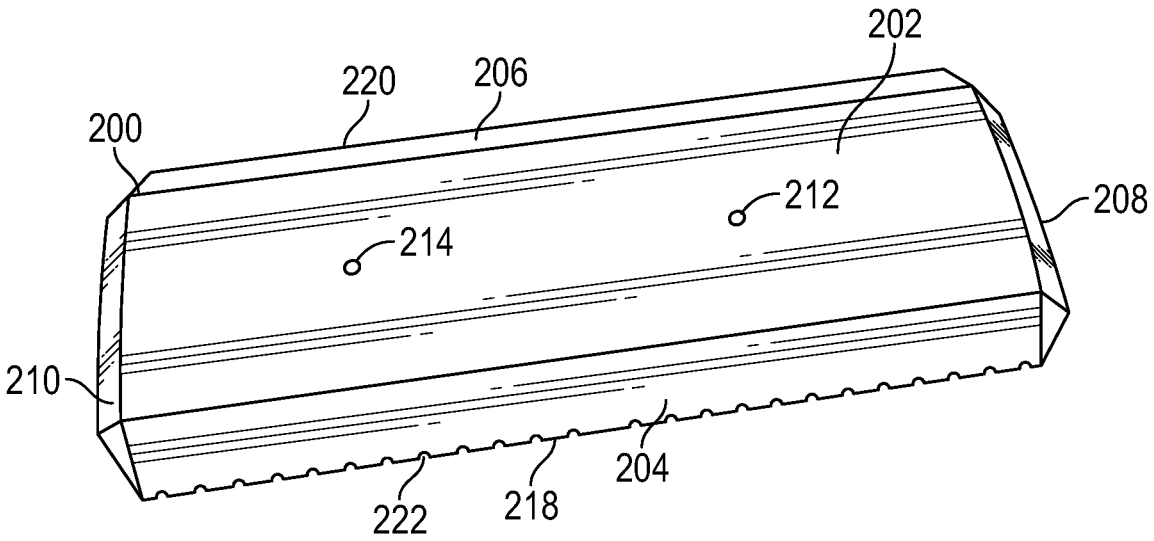
FIG. 3 illustrates a top perspective view of a shell that may be used in constructing a base of the cable clamp, according to an embodiment.
Figure 4:
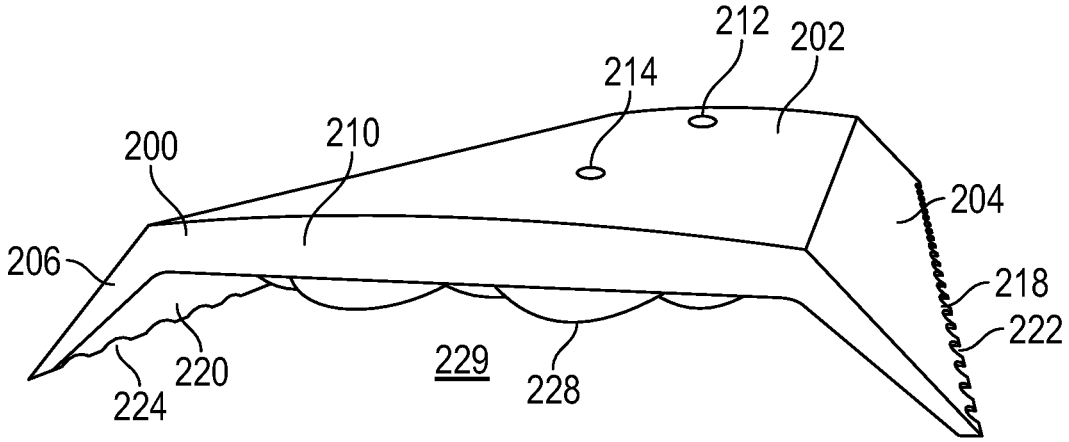
FIG. 4 illustrates a side perspective view of a shell that may be used in constructing a base of the cable clamp, according to an embodiment.
Figure 5:
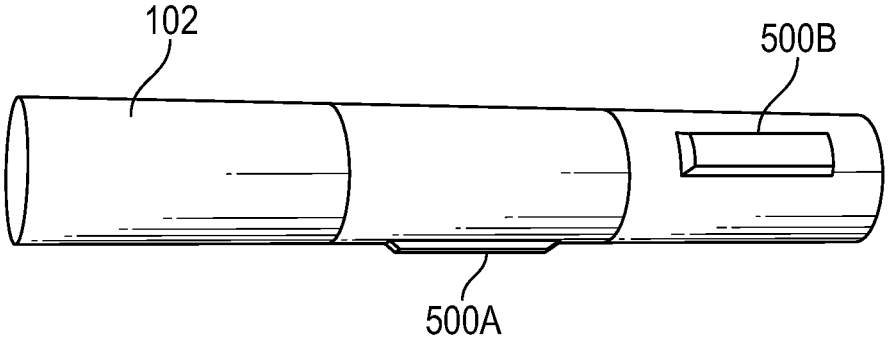
FIG. 5 illustrates a side view of a tubular modified by application of the cable clamps, according to an embodiment.

Referring now to FIGS. 2-4, there is shown perspective views of a shell 200, from which the base 106 and/or the cover 108 illustrated in FIG. 1 may be formed, according to an embodiment. In some embodiments, the shell 200 may be formed and attached to the tubular 102 illustrated in FIG. 1, forming a "protrusion" therefrom, as described, according to one or more embodiments, in U.S. Patent Publication Nos. 2014/0367085 and 2015/0021047, which are incorporated herein by reference in their entireties, to the extent they are not inconsistent with the present disclosure. The protrusion may be modified in shape to support the present cable clamp (e.g., cable claim 100) and its operation.

The shell 200 may be formed from a "composite" material, such as a fiber-reinforced resin material (e.g., fiber-reinforced plastic, glass-fiber-reinforced plastic, or the like). The resin material is a hardenable material, optionally including curing agents and curing modifiers. The resin may be self-curing, or provided in two components which harden when brought together. The two component system may be a matrix-forming (pre-polymer) component and a hardener. Suitable resins include epoxy resins, polyurethanes and polyurea resins including blends or hybrids thereof, and other curable resin components including polyester or polyol or polyamine components. The curing of the resin may be controlled by use of amine curing agents such as polyetheramines. Other additives may be present.

Further, the shell 200 may be molded to any suitable shape. In an embodiment, the fiber-reinforced resin material may be surface treated before molding of the shell 200. The fiber-reinforced resin material may have a ceramic particulate applied. The fiber-reinforced material may have a friction-modifying material applied. A combination of such surface treatments may be used. The surface treatment may be a surface modifying finish to an external surface of the molded shell. Additional particulate materials may be present within the bulk of the fiber-reinforced resin material. The particulates may be in bead form.

In the illustrated embodiment, the shell 200 may have an outer contact or bearing surface 202. In an embodiment, the outer surface 202 may be generally planar with peripheral sloping or beveled sides 204, 206, 208, and 210. In other embodiments, the bearing surface 202 may be convex or curved and/or may include ridges, protrusions, or any other type of facets.

Injection ports 212, 214 may be defined through the shell 200, e.g., extending through the outer bearing surface 202. In an embodiment, at least one of the ports 212, 214 may serve as an injection location for a flowable bonding material, such as an epoxy that may be injected within the shell 200. The other one of the ports 212, 214 may serve as a location at which a reduced pressure within the shell 200 may be developed, to promote filling of the shell 200 by the flowable bonding material during injection, by removing air (and/or any other matter) from within the shell 200 during injection.

Further, the shell 200 may have peripheral edges 218, 220, e.g., running along the outer extents of the sides 204, 206, respectively. The peripheral edges 218, 220 may be adapted to allow passage of a flowable material between the shell 200 and a structure upon which the shell 200 is disposed (e.g., the tubular 102 of FIG. 1). For example, the edges 218, 220 may define recesses 222, 224, respectively, which may provide such passage. Further, an inner surface 226 of the shell 200 may include a plurality of curved ridges 228, e.g., in a fish-scale pattern, or any other suitable structure or geometry, in order to provide a keying surface to improve adhesion or bonding with a bonding material. The shell 200 may have a thin wall, and may thus define a cavity 229 between the inner surface 226 of the shell 200 and a tubular (e.g., the tubular 102 of FIG. 1) to which the shell 200 may be attached.

Optionally, the shell 200 may include one or more structural reinforcements. Examples of such structure reinforcements may include strengthening struts, such as the illustrated brace or "rib" 230. As shown, the rib 230 may extend from one side 204 to the opposite side 206. In some embodiments, one or more additional ribs may be provided and may extend transverse to the illustrated rib 230. Further, two or more ribs 230, whether parallel, transverse, intersecting, or otherwise positioned relative to one another may be provided.

With continuing reference to FIGS. 2-4, FIG. 5 illustrates the tubular 102 with protrusions 500A, 500B, each formed by application (e.g., attachment) of the shell 200, according to an embodiment, to the tubular 102. In order to apply the shell 200 to the tubular 102, a selected outer surface area of the tubular 102 may be prepared, e.g., such that the surface of the tubular 102 provides a clean, dry substrate with an appropriate surface profile and/or roughness.

The shell 200, which may be prefabricated prior to application thereof onto the tubular 400, may be positioned on the prepared area of the tubular 102, so that edges 218, 220 may abut (e.g., be contiguous with) the surface of the tubular 102. The shell 200 may be held in position temporarily on the tubular 102, e.g., by use of releasable fastenings such as removable straps, adhesive tape, etc.

A bonding material may then be injected into the cavity 229 through one or more of the ports 212, 214 in the shell 200, until the bonding material fills the cavity 229 and, for example, flows through the recesses 222, 224 (if provided). When a period sufficient for curing of the bonding material has elapsed, the straps and/or adhesive tape may be removed, as the bonding material may sure itself and the shell 200 to the surface of the tubular 102.

Referring again to FIG. 1, an understanding of the structure of the base 106 and/or the cover 108 may now be more fully appreciated, in view of the description of the shell 200, according to an embodiment. For example, the base 106 includes injection ports 110 for injection of the bonding material. Thus, after the base 106 is placed on the tubular 102, the bonding material may be injected into a cavity (e.g., similar to the cavity 229 of FIG. 4), through the ports 110 in the surface of the base 106 until, in some embodiments, the bonding material flows through the apertures defined between the recesses and the surface of the tubular 102. In one embodiment, suction may be applied to one or more of the ports 110, so as to evacuate air from the cavity during or prior to injection of the bonding material. In other embodiments, the injection of the bonding material itself may force air, or any other gases or fluids out of the ports 110, without requiring an externally-generated pressure differential (e.g., suction) to be applied to the ports. When a period sufficient for curing of the bonding material has elapsed, the straps and/or adhesive tape may be removed, and the base 106 may be generally permanently secured to the tubular 102.

Figure 6A:
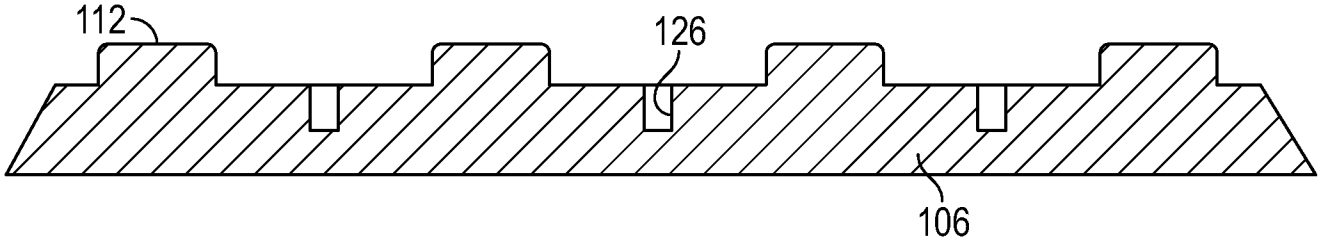
FIG. 6A illustrates a side, cross-sectional view of the base of the cable clamp, according to an embodiment.
Figure 6B:
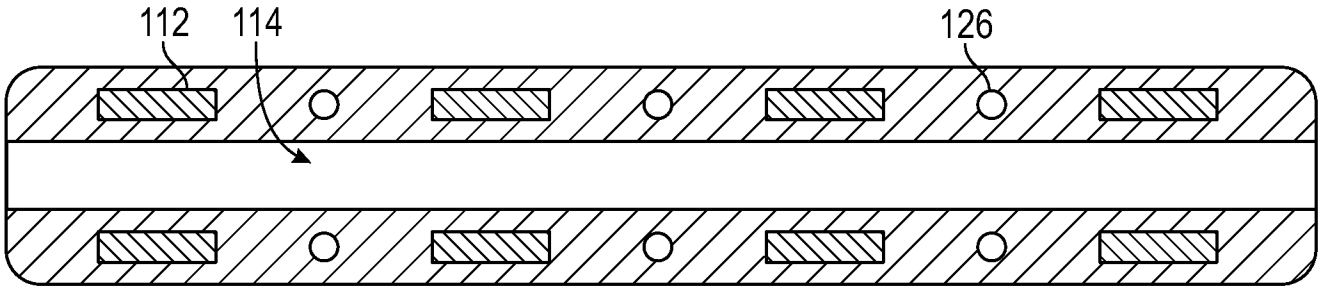
FIG. 6B illustrates a plan, cross-sectional view of the base of the cable clamp, according to an embodiment.
Figure 6C:
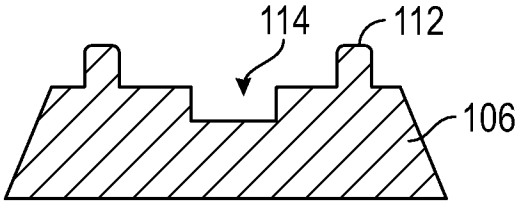
FIG. 6C illustrates an axial end, cross-sectional view of the base of the cable clamp, according to an embodiment.

FIGS. 6A-6C illustrate a side, cross-sectional view, a plan, cross-sectional view, and an axial end, cross-sectional view, respectively, of the base 106 of the cable clamp 100, according to an embodiment. As shown in FIG. 6A, the base 106 includes the upsets 112 extending radially outward from a remainder of the base 106, and the holes 126, which may be blind holes for receiving the connection members 125 (see, e.g., FIG. 7A). As shown in FIGS. 6B and 6C, the base 106 includes the groove 114 for receiving the cable 104 (FIG. 1). Although one groove 114 is shown in FIGS. 6B and 6C, any number of grooves may be used in the base 106 without departing from the present disclosure. Having multiple grooves may, for example, allow a user to select which groove facilitates alignment of cable 104 once the tubular 102 (FIG. 1) is connected to another tubular during the makeup of the string of tubulars. Additionally, having multiple grooves may allow multiple cables to be attached to the tubular 102 via a single cable clamp 100.

Figure 7A:
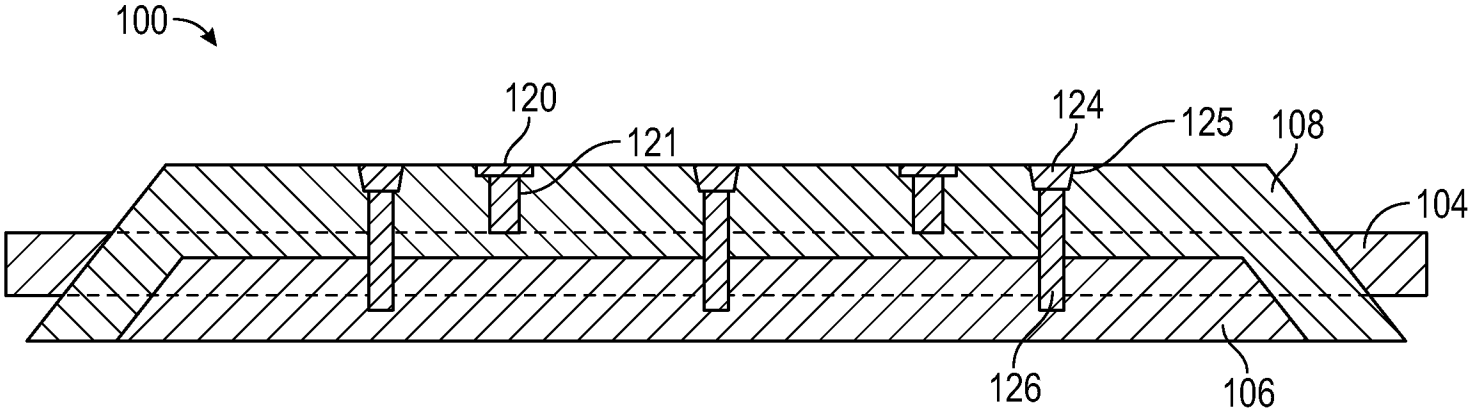
FIG. 7A illustrates a side cross-sectional view of the cable clamp, according to an embodiment.
Figure 7B:
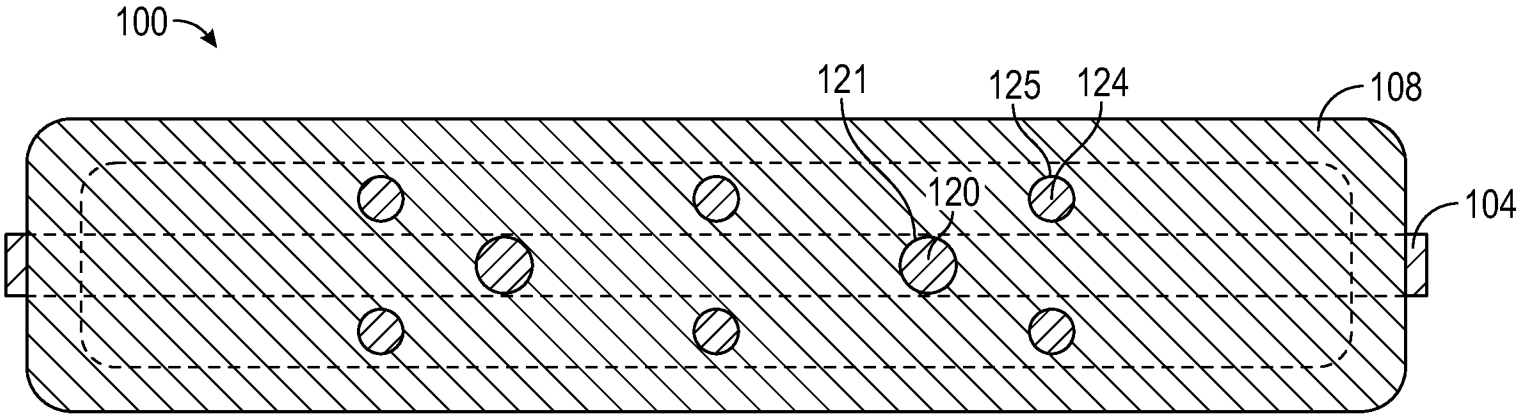
FIG. 7B illustrates a radial cross-sectional view of the cable clamp, according to an embodiment.

FIGS. 7A and 7B illustrate a side, cross-sectional view of the cable clamp 100 in a plane extending in an axial direction along the grooves 114, 118, and a radial, cross-sectional view of the cable clamp 100 in a plane extending circumferentially therethrough, respectively, according to an embodiment. In particular, FIGS. 7A and 7B illustrate the base 106 and the cover 108 connected together, with the cable 104 entrained therebetween. As shown specifically in FIG. 7A, the connecting members 125 are received through the cover 108 and into the holes 126 of the base 106. For example, threads of the connecting members 125 mesh with threads in the holes 126, resulting in a secure connection. Further, the connection members 120 (e.g., set screws) are received through the cover 108 via the holes 121, so as to secure a position of the cable 104 (shown in phantom for ease of viewing the clamp 100).

Figure 8:
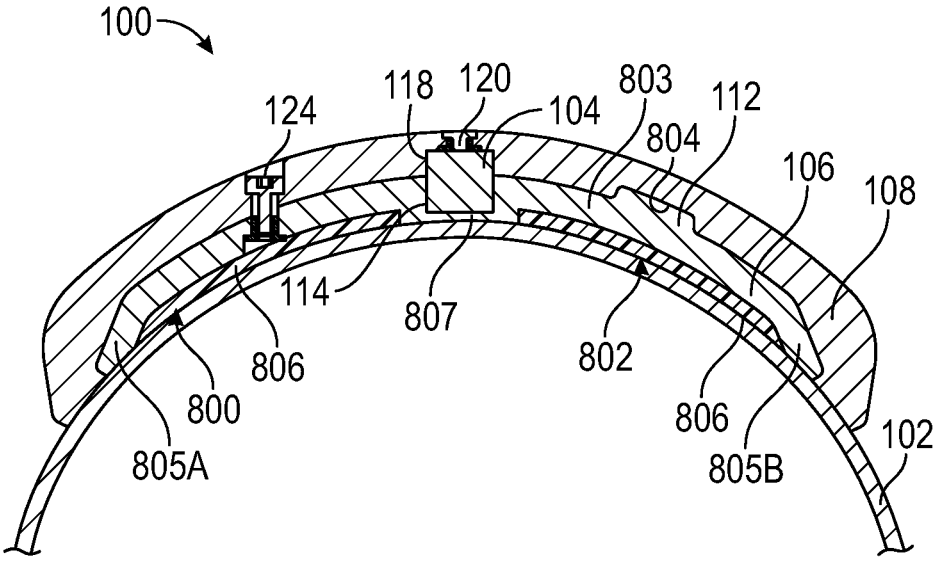
FIG. 8 illustrates an axial, cross-sectional view of the cable clamp, according to an embodiment.
Figure 9:
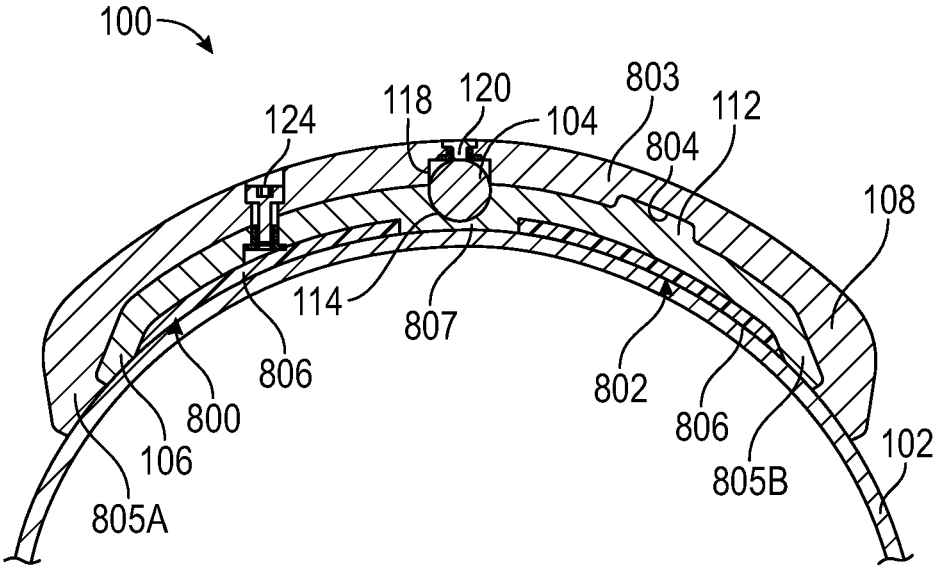
FIG. 9 illustrates an axial, cross-sectional view of the cable clamp, according to an embodiment.

FIGS. 8 and 9 illustrate cross-sectional views of the cable clamp 100, viewing a plane extending circumferentially through the cable clamp 100, according to an embodiment. As shown in FIG. 8, the cable 104 may have a square cross-section, at least within the grooves 114, 118, and the embodiment of the cable 104 in FIG. 9 has a round cross-section therein. As shown, the groove 114 and/or groove 118 may be configured (e.g., shaped) to fit cables having either such cross-section (and potentially others). Further, the connection members 120 engage either such cable 104.

In addition, FIGS. 8 and 9 illustrate cavities 800, 802 formed between a shell 803 of the base 106 and the tubular 102. The base 106 may be formed similarly to the protrusion discussed with respect to FIGS. 2-5, but, for example, instead of a single cavity within the shell 200, the base 106 may include the two cavities 800, 802 on either circumferential side of the groove 114. In other embodiments, any number of cavities may be employed.

In an embodiment, the shell 803 may be formed such that edges 805A, 805B thereof (and/or edges on either axial extent of the shell 803) are contiguous with (e.g., abut) the tubular 102. A central wall 807 may be positioned circumferentially between the cavities 800, 802, and may separate the cavities 800, 802. Further, the central wall 807 may form a bottom of the groove 114 and may be contiguous with the tubular 102 when the shell 803 is positioned on the tubular 102. Moreover, when the shell 803 is positioned on the tubular 102, the tubular 102 may form the radial inside of the cavities 800, 802.

A bonding material 806 may be disposed within the cavities 800, 802, e.g., injected therein through the ports 110 (see, e.g., FIG. 1). The bonding material 806 may cure within the cavities 800, 802, thereby serving to attach the shell 803 to the tubular 102, as well as to provide additional strength to the shell 803.

Further, as mentioned above, the upsets 112 of the base 106, extending radially outward, may be received into recesses 804 extending radially outward in the cover 108. The recesses 804 may be sized to snugly receive the upsets 112 therein. Accordingly, the connection members 120 may provide a radial force, pushing the cover 108 radially against the base 106, while the interlocking upsets 112 and the recesses 804 may take up axial and circumferential loads on the cover 108, and transmit such loads, via the base 106, to the tubular 102.

Figure 10:
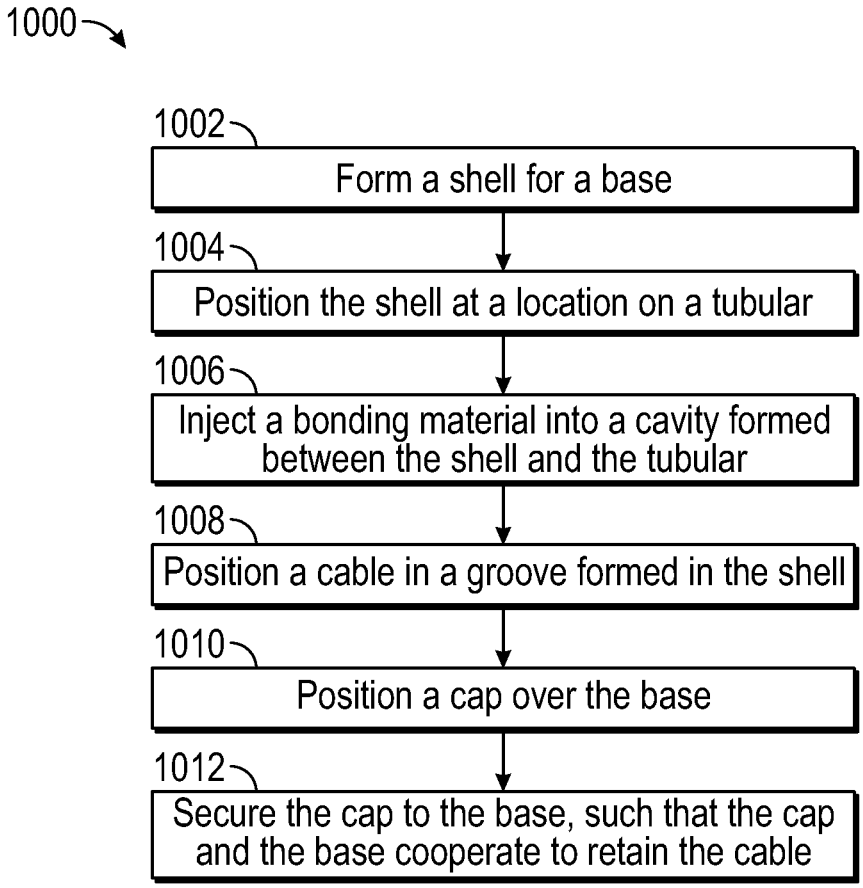
FIG. 10 illustrates a flowchart of a method for positioning a cable clamp on a tubular, according to an embodiment.

FIG. 10 illustrates a flowchart of a method 1000 for positioning a cable clamp on a tubular, according to an embodiment. Execution of the method 1000 may result in an embodiment of the cable clamp 100 discussed above, and thus the method 1000 is described herein with reference thereto. However, at least some embodiments of the method 1000 may result in other types of cable clamps, and thus the method 1000 should not be considered limited to any particular structure unless otherwise stated herein.

In addition, FIGS. 11A-11D illustrate perspective views of two cable clamps 100A, 100B being positioned onto the tubular 102 at various stages, consistent with an embodiment of the method 1000. The cable clamps 100A, 100B may illustrate embodiments of the cable clamp 100 discussed above. The method 1000 will be described herein with particular reference to cable clamp 100A, with it being appreciated that the construction of cable clamp 100B may be substantially similar (e.g., the same).

Figure 11A:
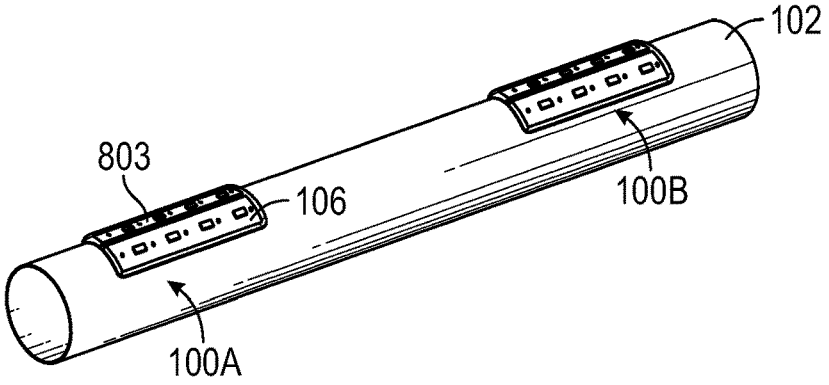
FIG. 11A illustrates a first sequential view of a cable clamp being positioned on a tubular, according to an embodiment.

The method 1000 may begin by forming the shell 803 for the base 106, as at 1002. In particular, in an embodiment, the shell 803 may be pre-fabricated, e.g., prior to attachment thereof to the tubular 102. The method 1000 may also include positioning the pre-fabricated shell 803 on the tubular 102, as at 1004, and as depicted in FIG. 11A. The shell 803 may be placed at a predetermined location of the tubular 102, which may have been prepared in advance (e.g., cleaned, roughed, smoothed, etc.). In some embodiments, the shell 803 may be temporarily secured as part of such positioning using a strap, adhesive tape, etc. The shell 803 may be configured such that edges 805A, 805B (see FIG. 8) thereof are contiguous with the tubular 102, and thus the shell 803 may define the cavities 800, 802 therein, with the tubular 102 providing a radial inside of the cavities 800, 802.

The method 1000 may then proceed to injecting the bonding material 806 (FIG. 8) into the cavities 800, 802, as at 1006, whether sequentially, simultaneously, or during overlapping periods of time. The bonding material 806 may then be allowed to cure, so as to form a stable connection between the shell 803 and the tubular 102, as well as providing additional strength to the shell 803.

Figure 11B:
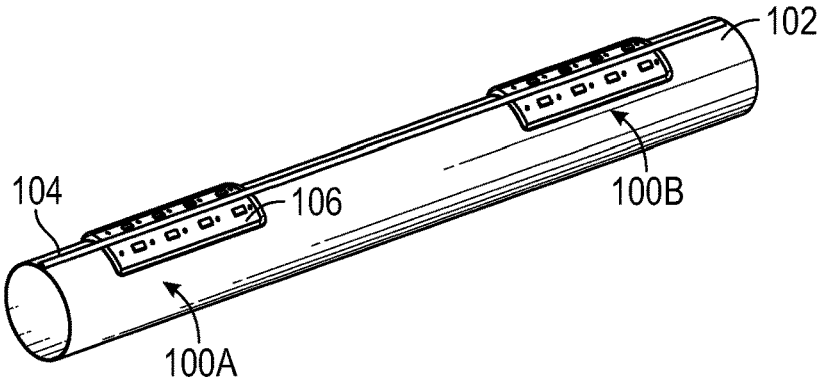
FIG. 11B illustrates a second sequential view of a cable clamp being positioned on a tubular, according to an embodiment.

Before, during, or after such injecting and/or curing, the method 1000 may include positioning the cable 104 in the groove 114 formed in the shell 803 of the base 106, as at 1008. This is illustrated in FIG. 11B. As can be seen, the cable 104 may be received laterally into the groove 114, since the groove 114 may be open-ended on a radial outside thereof, and/or the cable 104 may be threaded into the groove 114 in an axial direction.

Figure 11C:
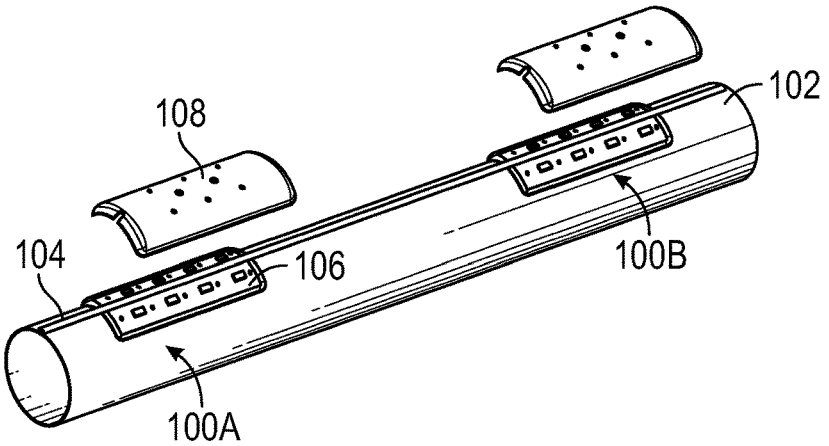
FIG. 11C illustrates a third sequential view of a cable clamp being positioned on a tubular, according to an embodiment.
Figure 11D:
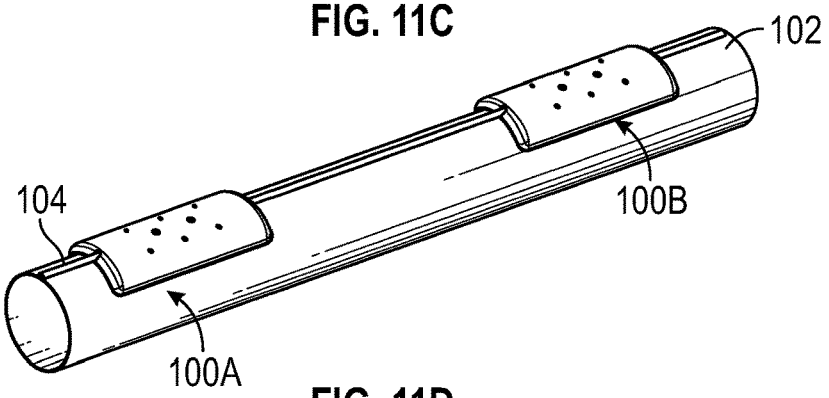
FIG. 11D illustrates a fourth sequential view of a cable clamp being positioned on a tubular, according to an embodiment.

The cover 108 may then be positioned over the base 106, at least spanning the groove 114, and optionally covering substantially an entirety of the base 106, as at 1010. This is illustrated in FIG. 11C. The cover 108 may then be secured, as at 1012, to the base 106, such that the cover 108 and the base 106 cooperate to retain the cable 104 in the groove 114, as shown in FIG. 11D. In an embodiment, the cover 108 may be fastened to the base 106 by the connection members 125. Further, in an embodiment, the connection members 120 may be tightened to secure a position of the cable 104 within the groove 114. In some embodiments, the base 106 and the cover 108 may form a keyed connection, such as with the upsets 112 being received into recesses 804 formed in the cover 108.

Figure 12:
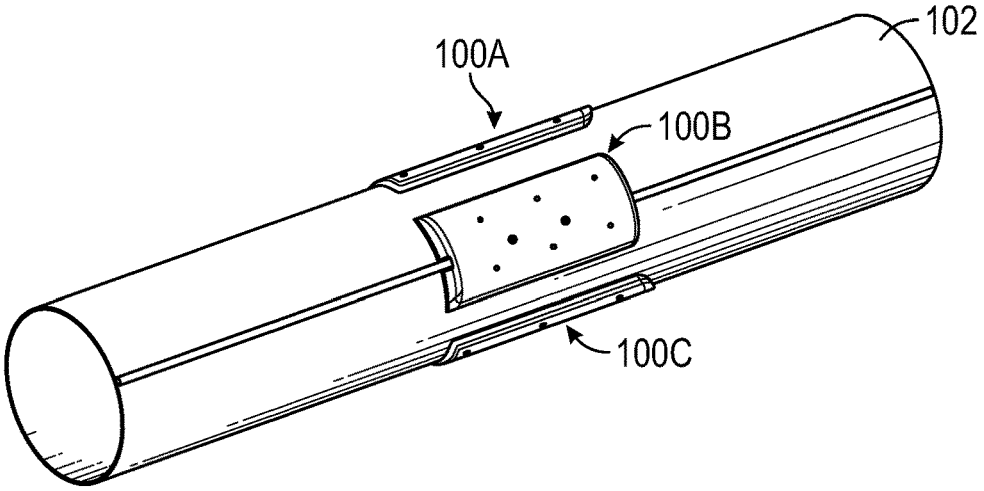
FIG. 12 illustrates a perspective view of an embodiment having a plurality of cable clamps positioned on a tubular.

FIG. 12 illustrates a perspective view of the several of the cable clamps 100A, 100B, 100C on the tubular 102, according to an embodiment. As shown, the cable clamps 100A-C may be aligned along a circumference of the tubular 102, e.g., at a common axial location. In a similar manner as described herein, multiple bases 106 may be attached to the tubular 102, e.g., in the yard during the installation process, and then transported to a rig site. At the rig site, the tubular 102 may be attached to a string of tubulars and the user may select the base 106 along the circumference of the tubular 102 that aligns the best with the cable clamp previously installed on the string of tubulars, and/or according to any other factor.

Because the tubular 102 may be rotated into connection with the tubular string, it may be difficult to anticipate the circumferential location of the cable clamp 100 that aligns with the cable 104, which may be secured to the tubular string and/or a tool coupled to the tubular string. Thus, the use of multiple previously-attached bases 106 positioned at one or more angular intervals around the tubular 102 may provide flexibility in selecting the location of the cable clamp 100 on the tubular 102. Once the base 106 is selected, then the cable 104 may be inserted in the groove 114 of the base 106 and the cover 108 may be attached to the base 106 to form the cable clamp 100.

The cable clamp 100 may also be used as a positioning device (e.g., pads of a centralizer or stabilizer). Accordingly, covers 108 may also be attached to the "unused" bases 106 (i.e., the bases 106 through which the cable 104 is not received) to form such positioning members. As a result, the "used" cable clamp 100B and the "unused" cable clamps 100A,C may cooperate to function as positioning members, e.g., providing a standoff (e.g., an annulus) between the tubular 102 and a surrounding tubular (e.g., casing, the wellbore wall, etc.).

Figure 13:
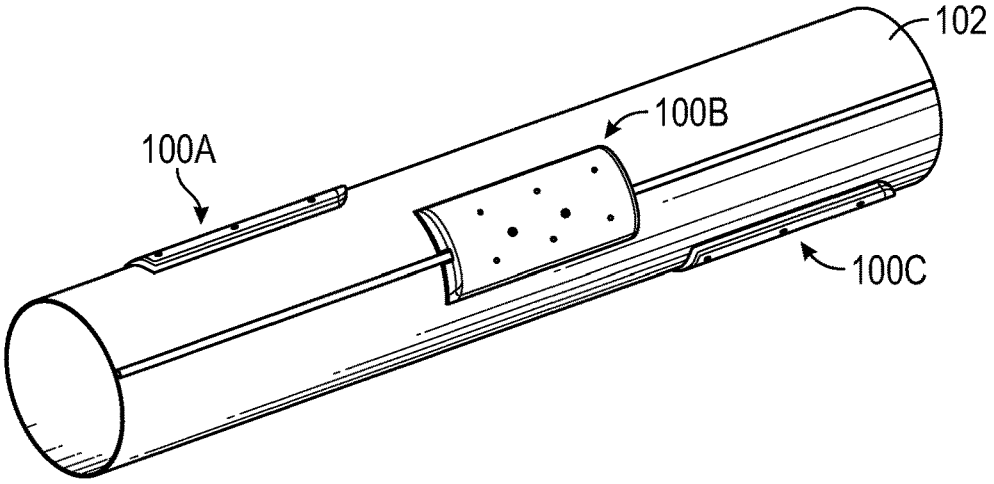
FIG. 13 illustrates a perspective view of an embodiment having a plurality of cable clamps positioned on a tubular.

FIG. 13 illustrates a perspective view of a tubular 102 modified to include several cable clamps 100A, 100B, 100C positioned thereon, according to another embodiment. As shown, the cable clamps 100A-C may be staggered along the circumference of the tubular 102 (e.g., not axially aligned, but offset and/or overlapping in an axial direction). In a similar manner as described in relation to FIG. 12, multiple bases 106 may be attached to the tubular 102 in the yard during the installation process and then transported to the rig site for use with a tubular string. The cable clamp 100B may ultimately be the "used" cable clamp, as it is selected for the cable 104 to run therethrough, while the remaining cable clamps 100A,C,D may be "unused," at least with respect to the cable 104, and may thus serve as positioning members.

Figure 14:
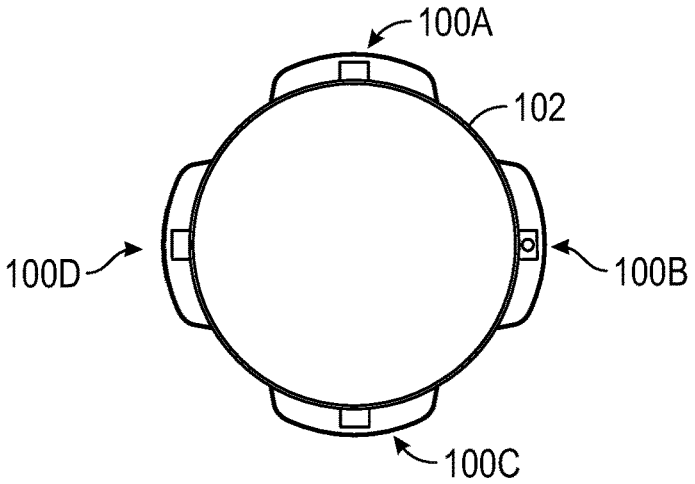
FIG. 14 illustrates an axial end view of a plurality of cable clamps positioned on a tubular, according to an embodiment.

FIG. 14 illustrates an axial end view of a tubular 102 modified to include (at least) four cable clamps 100A, 100B, 100C, 100D, according to an embodiment. It will be appreciated that any number of cable clamps 100 may be attached to the tubular 102 without departing from the present disclosure. For instance, a larger diameter tubular 102 may have five or six cable clamps 100 while a smaller diameter tubular 102 may have two or three cable clamps. In either example, the used cable clamp 100B and the unused cable clamps 100A,C,D may function as positioning members to facilitate appropriate positioning of the tubular 102 in a borehole and reduce drag due to friction while the tubular 102 is being installed into the borehole.

Figure 15A:
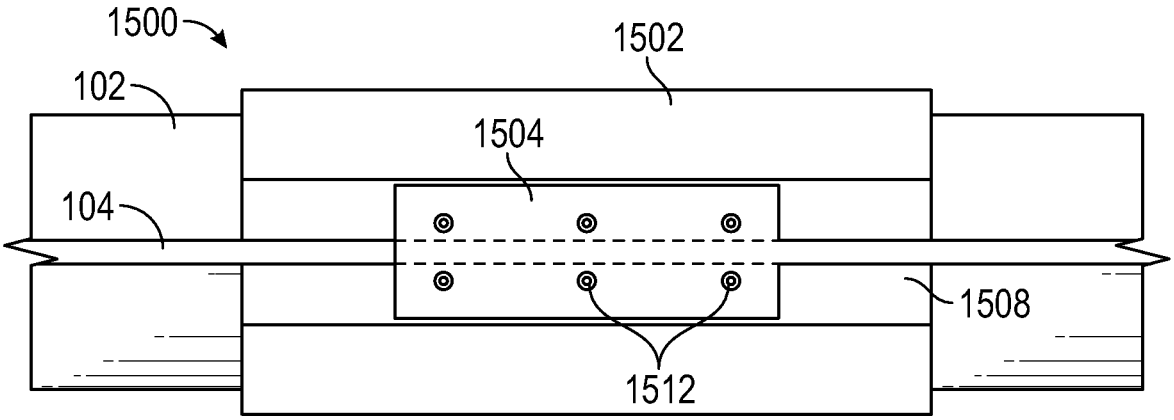
FIG. 15A illustrates a side view of another cable clamp on a tubular, according to an embodiment.
Figure 15B:
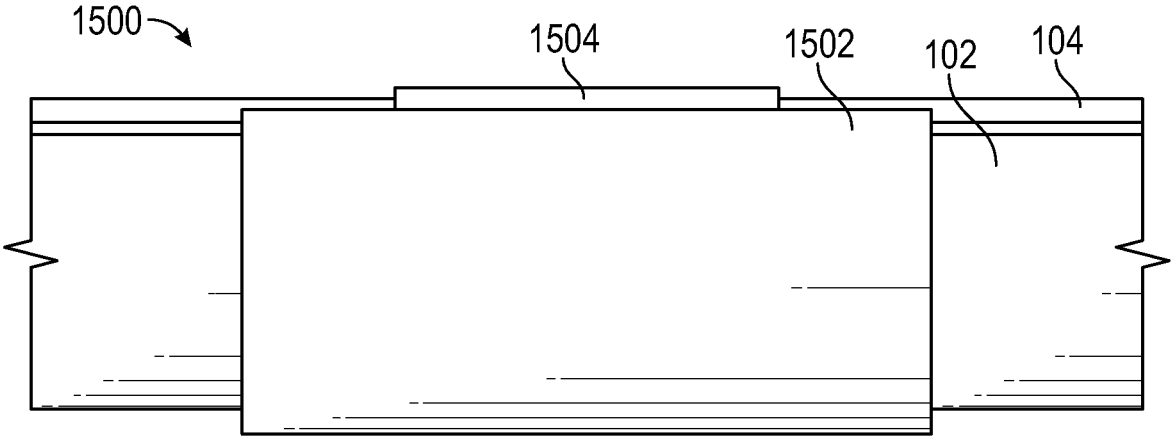
FIG. 15B illustrates a side view of another cable clamp on a tubular, according to an embodiment.
Figure 15C:
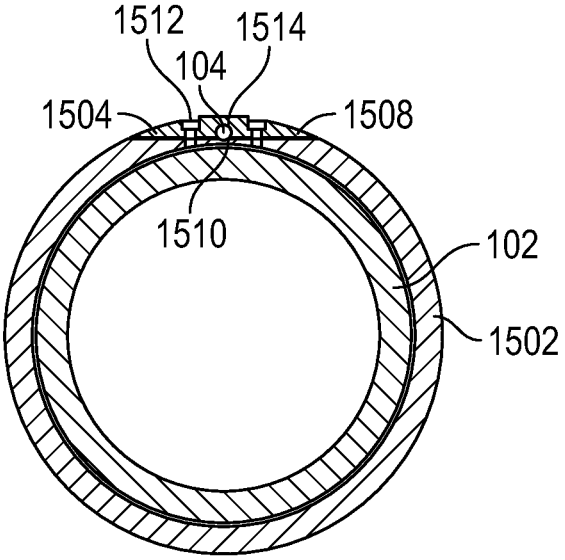
FIG. 15C illustrates an axial, cross-sectional view of the cable clamp of FIGS. 15A and 15B, according to an embodiment.

FIGS. 15A-15C illustrate a first side view, a second side view (rotated from the first side view), and an axial, cross-sectional view, respectively, of a cable clamp 1500, according to an embodiment. As shown in FIG. 15A, the cable clamp 1500 includes a base 1502 and a cover 1504, which may be similarly formed as the base 106 and cover 108, and may perform a similar function. The base 1502 may be installed on the tubular 102 in the yard or another location and then the tubular 102 with the base 1502 may be transported to the rig.

In a similar manner as described herein with respect to the base 106 of the clamp 100, a bonding material may be injected into a cavity formed between a shell of the base 1502 and the tubular 102, e.g., through one or more ports in the shell of the base 1502. The bonding material may be injected, for example, until it flows through apertures defined between the recesses and the surface of the tubular 102, to secure the shell to the tubular 102.

The base 1502 may extend circumferentially around the tubular 102, e.g., entirely around the tubular 102. In some embodiments, the base 1502 may be formed from two or more arcuate shells, which are axially aligned around the tubular 102, circumferential edge-to-edge, and then secured to the tubular 102 to form a generally continuous ring around the tubular 102. The two arcuate shells may, for example, have interlockable female and male sides, which may be provided to account for diameter tolerances in the tubular 102. In some embodiments, the base 1502 may include one or more gaps as between such adjacent shells. In other embodiments, the base 1502 may be a continuous sleeve that may be received over an end of the tubular 102.

Further, the base 1502 may define one or more flats 1508 where the base 1502 deviates from a cylindrical shape, and may form a flattened plateau of varying radial thickness (e.g., parallel to a line drawn tangent to the tubular 102). A groove 1510 for receiving the cable 104 may be formed in the flat 1508. In some embodiments, the groove 1510 may be large enough such that the cable 104 is received below the outer surface of the flat 1508, but in other embodiments, may be shallower, such that the cable 104 extends outwards from the groove 1510.

The cover 1504 may also be prefabricated and then transported to the rig for subsequent attachment to the tubular 102, via the base 1502. In an embodiment, the cover 1504 may be sized to be disposed on the flat 1508 of the base 1502, and may be secured thereto via fasteners, such as connecting members 1512 (e.g., steel, composite, or brass screws). As can be appreciated from FIGS. 15B and 15C, the cover 1504 may also provide an axially-extending groove 1514, which may cooperate with the groove 1510 of the base 1502 to provide a passageway for the cable 104 through the cable clamp 1500. The outer surface of the cover 1504 may have a radius of curvature that substantially matches a radius of curvature of the base 1502 away from the flat 1508, such that the cable clamp 1500 forms a generally cylindrical shape when the cover 1504 is positioned on the flat 1508.

Once installed on the tubular 102, in addition to its function of maintaining a position of the cable 104, the cable clamp 1500 may also be used as a positioning member on the tubular to facilitate appropriate positioning of the tubular 102 in a borehole and reduce drag due to friction while the tubular 102 is being installed into the borehole.

A single base 1502 may include several flats 1508, which may provide the aforementioned functionality of allowing a user to select from multiple positions at which the cable 104 may be retained. Further, prior to deployment, each of these flats 1508 may be covered by a separate cover 1504, thereby forming a generally cylindrical structure for the exterior of the cable clamp 1500. In other embodiments, it may be advantageous to leave one or more of the flats 1508 uncovered, so as to provide flowpaths for fluids or other materials past the cable clamp 1500 within the borehole.

Figure 16:
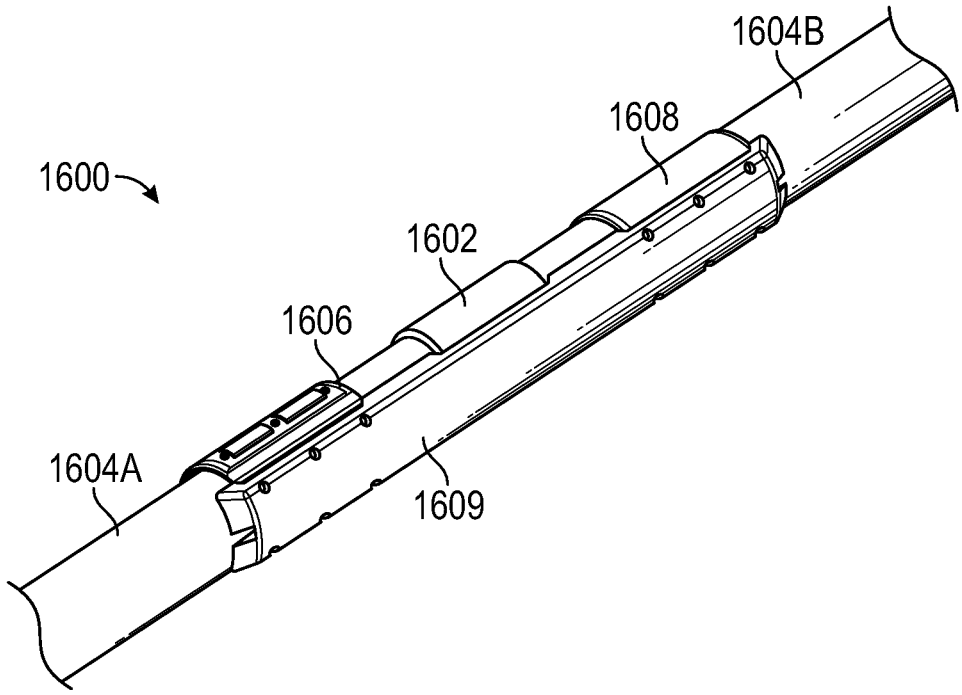
FIG. 16 illustrates a perspective view of another cable clamp positioned on a tubular, according to an embodiment.

FIG. 16 illustrates a perspective view of another cable clamp 1600, according to an embodiment. The cable clamp 1600 may span a coupling 1602 between a first tubular 1604A and a second tubular 1604B. The coupling 1602 may be a female (box) end of the one of the tubulars 1604A, 1604B, or a separate cylindrical collar that is connected to, and forms a connection between, the tubulars 1604A, 1604B.

The cable clamp 1600 generally includes a first base 1606 disposed on the tubular 1604A, a second base 1608 disposed on the tubular 1604B, and a cover 1609 that extends between and over the first and second bases 1606, 1608. As can be seen, the coupling 1602 is positioned axially between the first and second bases 1606, 1608, and thus the cover 1609 extends over the coupling 1602. In an embodiment, one or more second covers may be positioned over the portions of the first base 1606 that are not covered by the cover 1609, e.g., to provide positioning members, avoid damage to the first base 1606, etc.

The first and second bases 1606, 1608 may extend around the respective tubulars 1604A, 1604B. Further, the first base 1606 may be secured to the tubular 1604 via a bonding material injected into a cavity formed between a shell of the first base 1606 and the tubular 1604A, e.g., as described above with respect to FIGS. 2-5. In some embodiments, the first and second bases 1606, 1608 may be substantially similar (e.g., identical in construction). In other embodiments, however, the second base 1608 may, prior to connecting the cover 1609, be received around the tubular 1604B, but may, in some embodiments, not be positionally fixed thereto. Thus, the second base 1608 may be free to rotate relative to the tubular 1604B, as will be described in greater detail below. In other embodiments, the first and second bases 1606, 1608 may both be secured to the respective tubulars 1604A, 1604B and to the cover 1609.

Figure 17A:
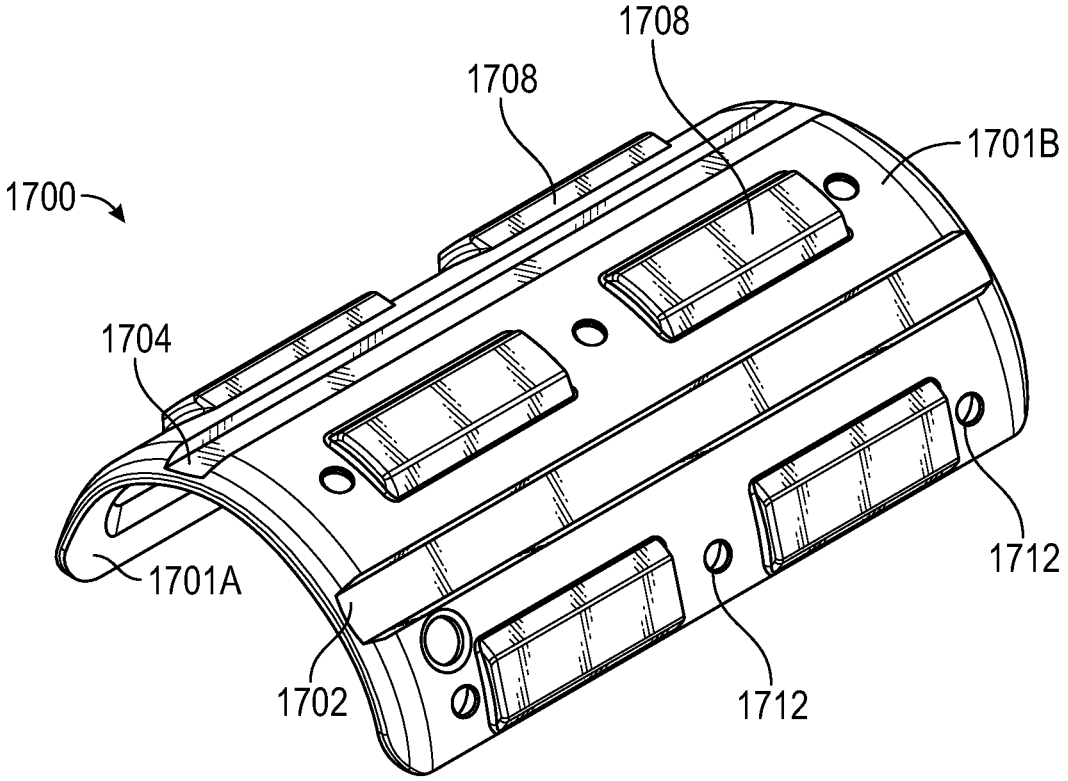
FIG. 17A illustrates a top, perspective view of an arcuate shell that may be used in constructing a first base of the cable clamp of FIG. 16, according to an embodiment.
Figure 17B:
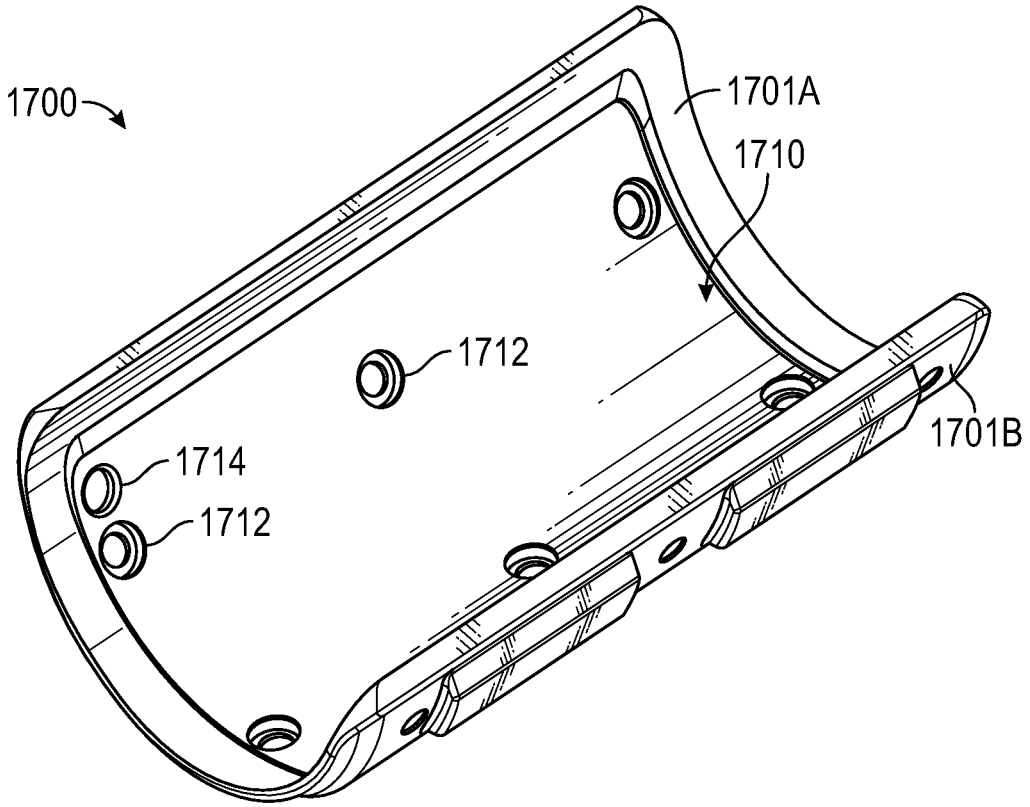
FIG. 17B illustrates a bottom, perspective view of an arcuate shell that may be used in constructing a first base of the cable clamp of FIG. 16, according to an embodiment.

FIGS. 17A and 17B illustrate perspective views of an arcuate shell 1700 that may be used to form part of the first base 1606, according to an embodiment. As shown, the arcuate shell 1700 may extend about 180 degrees, and thus the first base 1606 may be formed from two of the arcuate shells 1700 positioned around the tubular 1604A. In other embodiments, the arcuate shell 1700 may extend to any other angular dimension, and thus the first base 1606 may be formed from any number of arcuate shells 1700. Further, the arcuate shells 1700 forming the base 1606 may or may not all extend by the same angular dimension.

The arcuate shell 1700 may have an inner surface 1701A and an outer surface 1701B, with the inner surface 1701A being configured to face the tubular 102 and the outer surface 1701B facing outward. One or more grooves (two are shown: 1702, 1704) may extend radially inward from the outer surface 1701B and may extend axially along at least a portion of the axial length of the shell 1700. In some embodiments, the grooves 1702, 1704 may be positioned at generally uniform angular intervals, and may extend along the entire axial length of the shell 1700. The grooves 1702, 1704 may each be sized and configured to receive a cable (e.g., the cable 104) therein.

The arcuate shell 1700 may also include a one or more upsets 1708, defined extending radially outward from the outer surface 1701B. Optionally, the upsets 1708 may be disposed in rows of two or more and positioned circumferentially adjacent to the grooves 1702, 1704. In other embodiments, the upsets 1708 may be circumferentially offset from one another while also being adjacent to the grooves 1702, 1704, or a row may be provided by a single upset 1708. Further, in some embodiments, the upsets 1708 may be generally rectangular prisms, with beveled sidewalls, but in other embodiments, may be any other suitable shape. The upsets 1708 may be employed to establish a rigid connection with the cover 1609 as will be described in greater detail below.

The arcuate shell 1700 may also define a cavity 1710 extending radially outwards from the inner surface 1701A. The cavity 1710 may communicate with a plurality of connector holes 1712 and/or one or more injection ports 1714. The connector holes 1712 may be, for example, threaded, so as to mate with threads of a connection member, e.g., to secure the cover 1609 to the arcuate shell 1700, as will be described in greater detail below. In other embodiments, the cover 1609 may be secured to the arcuate shell 1700 using adhesives or the like, and thus the connector holes 1712 may be omitted. When provided, the connector holes 1712 may be positioned in circumferential alignment with the upsets 1708, as shown. The injection port 1714 may be configured to allow the bonding material to be injected into the cavity 1710, so as to form a rigid connection between the tubular 1604A and the arcuate shell 1700.

Figure 18:
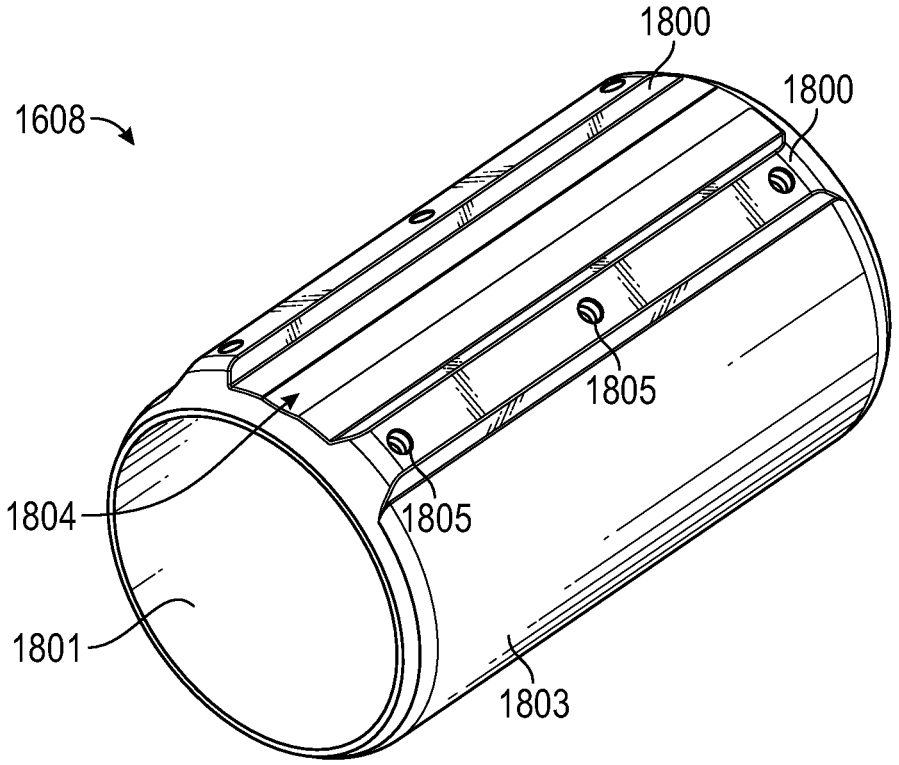
FIG. 18 illustrates a perspective view of a second base of the cable clamp of FIG. 16, according to an embodiment.

FIG. 18 illustrates a perspective view of the second base 1608, according to an embodiment. The second base 1608 may generally be formed as a sleeve, which may slide over an end of the tubular 1604B. The second base 1608 may thus have a relatively smooth inner surface 1801. Further, the second base 1608 may be a unitary cylindrical structure, but in other embodiments, may be formed as two or more segments that are coupled together, e.g., to allow for lateral placement of the second base 1608 around the tubular 1604B. The second base 1608 may be prefabricated prior to installation around the tubular 102.

The second base 1608 may also include a pair of upsets 1800 extending outwards from a radially-outer surface 1803 of the second base 1608. The upsets 1800 may be separated circumferentially apart from one another, and may extend along substantially the entire axial length of the second base 1608. In other embodiments, either or both upsets 1800 may be provided by a plurality of individual upsets 1800. Further, each of the upsets 1800 may include a plurality of (e.g., threaded) connector holes 1805 for receiving connection members that hold the cover 1609 onto the second base 1608. In some embodiments, the connector holes 1805 may be omitted, and the cover 1609 may be secured to the second base 1608 by adhesive, or in any other manner.

The second base 1608 may also define a cable slot 1804 circumferentially between the upsets 1800, 1802. In an embodiment, the cable slot 1804 may include two or more ridges that extend axially therein, as shown. Such ridges may facilitate holding the cable (e.g., the cable 104 of FIG. 1) in place between the cover 1609 and the second base 1608.

Figure 19A:
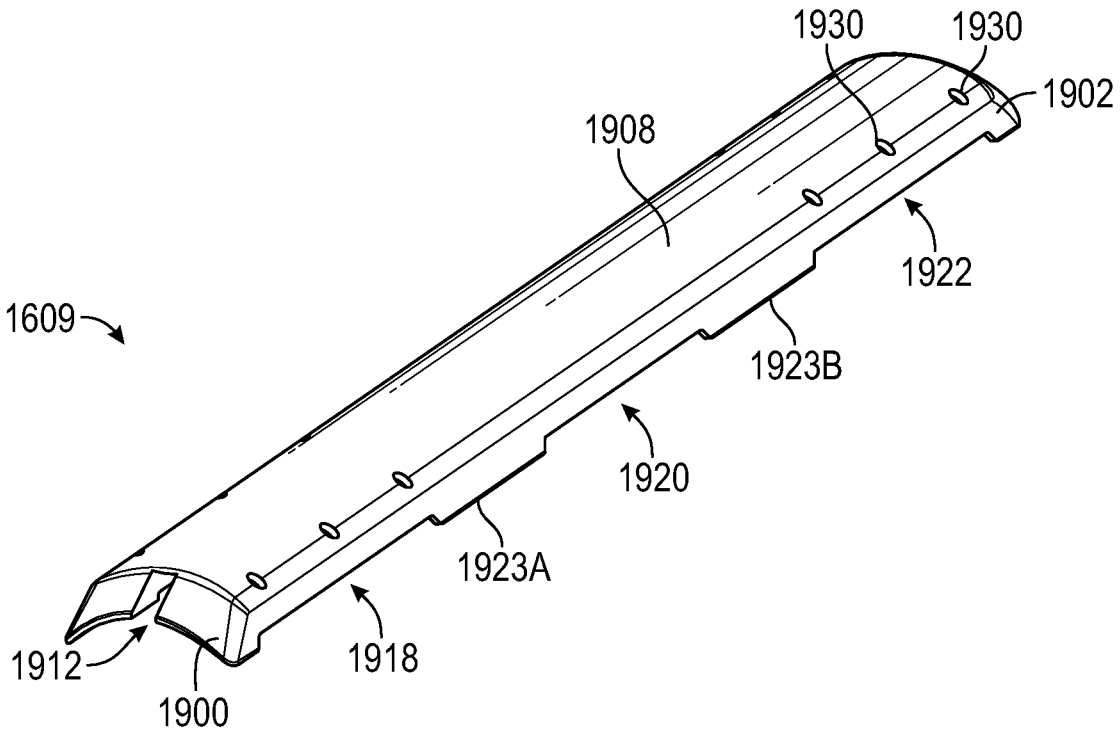
FIG. 19A illustrates a top perspective view of a cover of the cable clamp of FIG. 16, according to an embodiment.
Figure 19B:
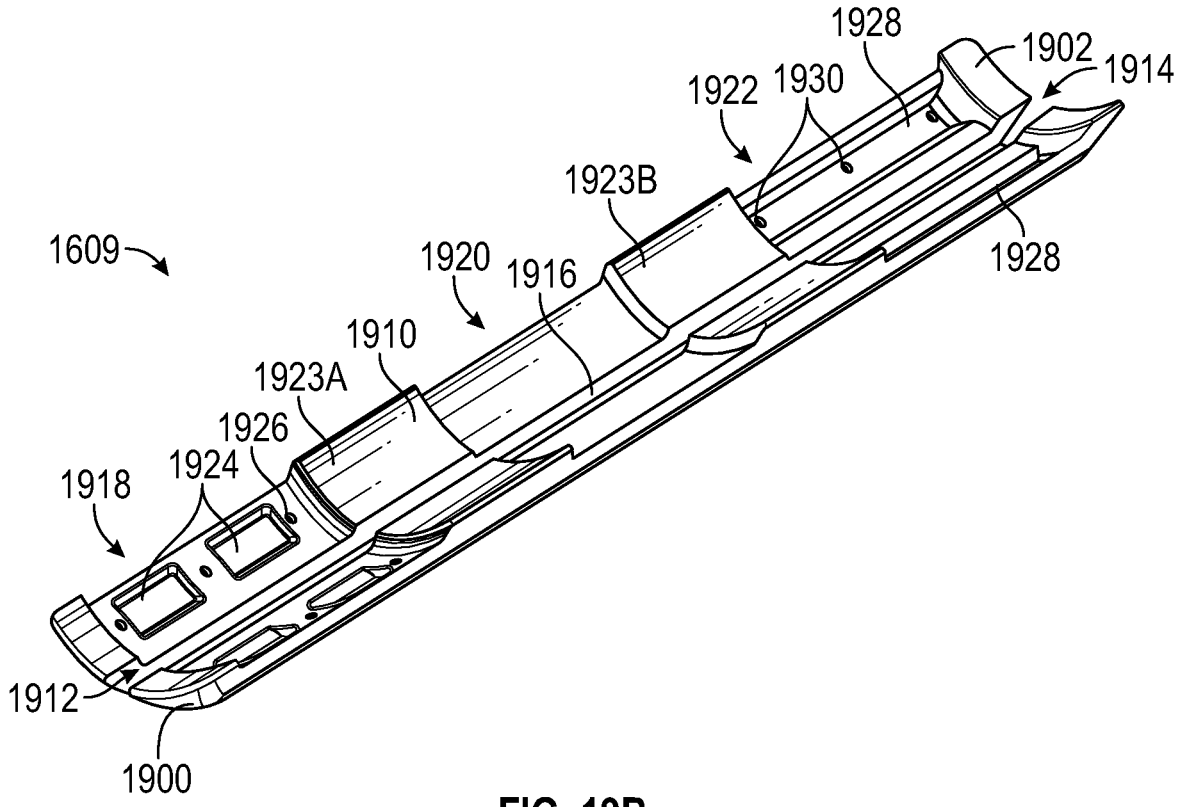
FIG. 19B illustrates a bottom perspective view of a cover of the cable clamp of FIG. 16, according to an embodiment.

FIGS. 19A and 19B illustrate two perspective views of the cover 1609, according to an embodiment. The cover 1609 may be generally arcuate in cross-section, and may extend by any angular dimension from about 10 degrees to about 180 degrees, e.g., about 45 degrees. The cover 1609 may include axial ends 1900, 1902 at opposite axial extents thereof. Further, the cover 1609 may have a radially outer surface 1908, and a radially inner surface 1910.

The ends 1900, 1902 may each define an opening 1912, 1914 therethrough. The openings 1912, 1914 may communicate with one another via a groove 1916 defined in the cover 1609 and extending therebetween. The groove 1916 may extend radially outward from the inner surface 1910, and may extend along the axial length of the cover 1609.

As mentioned above, the cover 1609 may be configured to couple to the first and second bases 1606, 1608, and span across the coupling 1602 positioned axially therebetween. Accordingly, the cover 1609 may include a first base depression 1918, a coupling depression 1920, and a second base depression 1922, each of which may be defined extending radially outward from the inner surface 1910. Between each of the depressions 1918, 1920, 1922, the inner surface 1910 may provide separating walls 1923A, 1923B configured to fit between and separate the first base 1606 and the coupling 1602, and the second base 1608 and the coupling 1602, respectively.

The cover 1609 may be configured to receive an angular portion of the first base 1606 in the first base depression 1918. The first base depression 1918 may thus include recesses 1924 therein, which may be sized and positioned to interlock with the upsets 1708 of one or more arcuate shells 1700 (FIG. 17) of the first base 1608. The cover 1609 may also define a plurality of connecting holes 1926 therein, extending therethrough between the outer surface 1908 and the inner surface 1910, and configured to be aligned with connecting holes 1712 of the one or more shells 1700 of the first base 1606. Connection members (e.g., screws) may be received therethrough, so as to couple the first base 1606 to the cover 1609. In some embodiments, the cover 1609 may be secured to the first base 1606 using other processes, and thus the holes 1926 may be omitted. When the cover 1609 is connected to the first base 1606, as shown in FIG. 16, the groove 1916 may cooperate with one of the grooves 1702, 1704 (or others), so as to provide a passageway for the cable therethrough.

In the second base depression 1922, the cover 1609 may be configured to receive an angular portion of the second base 1608. In particular, the cover 1609 may define upset recesses 1928 corresponding to the upsets 1800, such that the angular interval of the second base 1608 including the two upsets 1800 and the cable slot 1804 therebetween, is received into the second base depression 1922. Moreover, the cover 1609 may define connection holes 1930 extending therethrough, which may be aligned with the connection holes 1805 of the second base 1608, such that connection members may be received therethrough and thus couple the second base 1608 to the cover 1609. In some embodiments, the cover 1609 may be secured to the second base 1608 using other processes, and thus the holes 1930 may be omitted. When connected, the cable slot 1804 and the groove 1916 may cooperate to provide for passage of a cable between the cover 1609 and the second base 1608.

Further, the cover 1609 may receive an angular interval of the coupling 1602 in the coupling depression 1920.

Referring back to FIGS. 16, 17A, and 17B, when the first base 1606, second base 1608, and cover 1609 are connected together, the assembly thereof may be held in position by the attachment of the first base 1606 to the first tubular 1604A. The second base 1608 may not be secured in place directly to the second tubular 1604B, because it may be difficult to anticipate the correct circumferential position thereof, so that the upsets 1800, 1802 fit precisely into the upset recesses 1928 of the cover 1609 and/or so that the cable slot 1804 is aligned with the grooves 1702, 1704 of the shell(s) 1700 of the first base 1608. Accordingly, with the second base 1608 being rotatable relative to the second tubular 1604B, one of the grooves 1702, 1704 may be selected, the cover 1609 secured to the first base 1606, and then the second base 1608 may be rotated relative to the second tubular 1604B until the upsets 1800, 1802 are received into the upset recesses 1928. This may further result in the cable slot 1804 being generally aligned with the selected one of the grooves 1702, 1704, allowing the cable 104 to extend generally straight in an axial direction along the first and second tubulars 1604A,B. To ensure the cable clamp 1600 is pulled into the borehole, rather than pushed, the first tubular 1604A may be run into the borehole before the second tubular 1604B.

Figure 20:
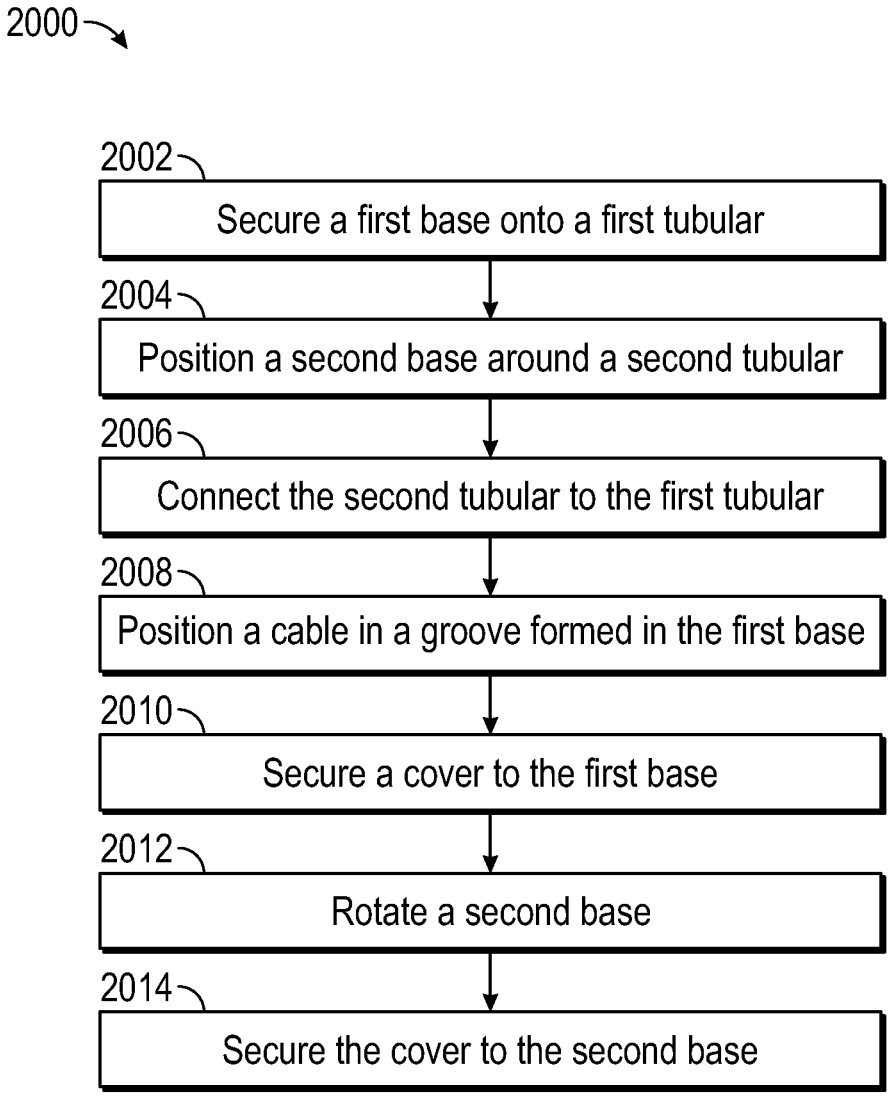
FIG. 20 illustrates a flowchart of another method for positioning a cable clamp on a tubular, according to an embodiment.

FIG. 20 illustrates a flowchart of a method 2000 for securing a cable to a tubular, according to an embodiment. Execution of the method 2000 may result in an embodiment of the cable clamp 1600, and thus the method 2000 will be described with reference thereto. However, at least some embodiments of the method 2000 may result in other structures, and thus the method 2000 should not be considered limited to any particular structure unless otherwise stated herein.

The method 2000 may include securing the first base 1606 to the first tubular 1604A, as at 2002. In an embodiment, this may include securing at least two prefabricated shells 1700 to the tubular 102, circumferentially end-to-end, and then injecting a bonding material into a cavity 1710 formed in each. In other embodiments, other types of shells 1700 may be employed.

The method 2000 may also include positioning the second base 1608 around a second tubular 1604B, as at 2004. In an embodiment, the second base 1608 may be rotatable (e.g., freely rotatable, temporarily secured to the tubular 1604B, etc.).

The method 2000 may then include connecting the second tubular 1604B to the first tubular 1604A, e.g., via the coupling 1602 (e.g., a separate collar or a box end of the first tubular 1604A), as at 2006. In an embodiment, the first tubular 1604A may be connected to a string of tubulars and at least partially deployed into a borehole prior to connecting there second tubular 1604B thereto at 2006, e.g., but optionally after the first base 1608 is secured to the tubular 1604A at 2002. In an embodiment, connecting the second tubular 1604B may include rotating the second tubular 1604B relative to the first tubular 1604A.

The method 2000 may also include positioning the cable 104 through at least one groove 1702, 1704 defined in the base 1606, as at 2008. The method 2000 may also include securing the cover 1609 to the first base 1606, as at 2010, e.g., after positioning the cable 104 at 2008. In an embodiment, the cover 1609 may be positioned such that the groove 1916 defined therein is aligned with the "used" groove 1702, 1704 in which the cable 104 is positioned at 2008. Securing the cover 1609 may entrain the cable 104 within the used groove 1702, 1704, e.g., radially between the base 1606 and the cover 1609. Further, securing the cover 1609 to the first base 1606 may include positioning at least one of the upsets 1708 of the first base 1606 within at least one corresponding recess 1924 of the cover 1609.

The method 2000 may also include rotating the second base 1608 relative to the first base 1608, the cover 1609, and/or the second tubular 1604B, as at 2012. For example, this may occur during or after securing the cover 1609 to the first base 1606. In an embodiment, the second base 1608 may be rotated until the upsets 1800 thereof are received into the recesses 1928 of the cover 1609. Further, the second base 1608 may be rotated until the cable slot 1804 thereof is aligned with the used groove 1702, 1704 and/or the groove 1916. The cover 1609 may also be secured to the second base 1608, as at 2014.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A cable clamp for attaching a cable to a tubular, the cable clamp comprising:

a first base that is configured to be attached to the tubular by a bonding material; and a second base that is axially offset from the first base;

a cover that is configured to be placed on the first base and the second base and coupled to the first and second bases, wherein at least one of the first base or the cover defines a groove extending therein, for receiving a cable through the cable clamp, and wherein the first base is radially between the cable and the tubular and prevents the cable from directly contacting the tubular underneath the first base;

wherein the second base comprises a sleeve received around the tubular, and wherein the sleeve is not in contact with the tubular;

the second base is fixed to the cover, such that the cover is not movable with respect to the second base;

the cover is fixed to the first base, such that the cover is prevented from displacement with respect to the first base; and the cover prevents displacement of the second base with respect to the first base, and the first base prevents displacement of the second base relative to the tubular via connection of the first and second bases to the cover.

2. The cable clamp of claim 1, wherein the first base comprises a prefabricated shell having a radial inside surface that is configured to face the tubular, the shell defining one or more cavities in the radial inside surface, and one or more injection ports extending through the shell and in communication with the one or more cavities, the bonding material being injected though at least one of the one or more injection ports and into the one or more cavities.

3. The cable clamp of claim 1, wherein:

the first base defines an outside surface configured to face away from the tubular, the first base comprising a plurality of upsets extending radially outward from the outside surface; and the cover defines a plurality of recesses configured to receive the plurality of upsets.

4. The cable clamp of claim 1, wherein the first base extends circumferentially around the tubular when attached thereto.

5. The cable clamp of claim 4, wherein the first base comprises one or more flats on a radial outside thereof, wherein the cover is configured to be connected to the first base so as to cover at least a portion of one of the one or more flats, and wherein the first base defines the groove extending along at least one of the one or more flats.

6. The cable clamp of claim 5, wherein the cover has an arcuate outer surface having a radius of curvature that substantially equals a radius of curvature of the first base away from the one or more flats.

7. The cable clamp of claim 1, wherein the first base is configured to be disposed on one side of a coupling, and the second base is configured to be disposed on an opposite side of the coupling, wherein the cover extends over the coupling.

8. The cable clamp of claim 1, wherein the second base comprises a plurality of upsets, and the cover comprises a plurality of upset recesses configured to receive the plurality of upsets of the second base.

9. The cable clamp of claim 1, wherein the second base comprises a sleeve received around an entire circumference of the tubular.

10. A method for attaching a cable to a tubular, the method comprising:

securing a first base to a first tubular, wherein attaching the first base comprises injecting a bonding material into a cavity defined between an inner surface of a shell of the first base and the first tubular;

positioning a cable along the first base, such that the first base is radially between the cable and the first tubular and prevents the cable from directly contacting the first tubular underneath the first base;

positioning a second base on a second tubular that is configured to be attached to the first tubular, wherein the second base is at least partially radially between the cable and the second tubular; and positioning a cover on the first and second bases, wherein the cable is positioned in a passageway defined by the first base, the cover, or both; and securing the cover to the first and second bases;

wherein the second base is configured to rotate relative to the second tubular prior to securing the cover to the second base; and wherein the method further comprises:

connecting the second tubular to the first tubular; and rotating the second base relative to the first base after connecting the second tubular to the first tubular and before connecting the cover to the second base, so as to circumferentially align at least a portion of the first base and at least a portion of the second base after the first and second bases have been received onto the first and second tubulars, respectively.

11. The method of claim 10, wherein securing the cover to the first base comprises receiving one or more upsets of the first base into one or more recesses defined in the cover.

12. The method of claim 10, wherein the shell comprises an arcuate cross-section, and wherein attaching the first base to the tubular further comprises attaching one or more other shells having an arcuate cross-section on the tubular, such that a circumferential end of the shell is adjacent to a circumferential end of the at least one of the one or more other shells, and wherein the first base extends substantially around the tubular.

13. The method of claim 10, wherein the first base extends circumferentially around the tubular and comprises one or more flats, wherein the cable is positioned along one of the one or more flats, and the cover covers at least a portion of the one of the one or more flats.

14. The method of claim 10, wherein securing the cover to the second base comprises positioning one or more upsets of the second base into one or more recesses formed in the cover.

15. The method of claim 14, wherein:

the one or more upsets of the second base comprises a first upset and a second upset;

the second base defines a cable slot circumferentially between the first and second upsets; and rotating the second base comprises aligning the cable slot with the passageway defined by the cover, the first base, or both.

* * * * *